US009199808B2

(12) United States Patent
Shiokawa et al.

(10) Patent No.: US 9,199,808 B2
(45) Date of Patent: Dec. 1, 2015

(54) PAPER FEEDING CASSETTE AND IMAGE FORMING APPARATUS

(75) Inventors: Yasuo Shiokawa, Toyokawa (JP); Ichiro Muramatsu, Hamamatsu (JP); Takaaki Namiki, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/026,423

(22) Filed: Feb. 14, 2011

(65) Prior Publication Data

US 2011/0210501 A1 Sep. 1, 2011

(30) Foreign Application Priority Data

Feb. 26, 2010 (JP) ..... 2010-042809

(51) Int. Cl.
*B65H 1/00* (2006.01)
*B65H 1/26* (2006.01)
*G03G 15/00* (2006.01)

(52) U.S. Cl.
CPC ..... *B65H 1/266* (2013.01); *G03G 15/6502* (2013.01); *B65H 2403/47* (2013.01); *B65H 2405/325* (2013.01); *B65H 2511/11* (2013.01); *B65H 2511/20* (2013.01)

(58) Field of Classification Search
CPC ..... B65H 2511/12; B65H 2701/1131
USPC ..... 271/171, 145; 399/393
See application file for complete search history.

(56) References Cited

U.S. PATENT DOCUMENTS

| | | | | | |
|---|---|---|---|---|---|
| 3,563,535 | A * | 2/1971 | Vitu et al. | ..... | 271/157 |
| 5,029,841 | A * | 7/1991 | Ettischer et al. | ..... | 271/171 |
| 6,926,269 | B2 * | 8/2005 | Ishikuro | ..... | 271/171 |
| 2006/0222434 | A1 * | 10/2006 | Kitamura et al. | ..... | 271/171 |
| 2007/0189822 | A1 * | 8/2007 | Nakamura | ..... | 399/393 |
| 2008/0298873 | A1 * | 12/2008 | Yamagishi | ..... | 400/624 |
| 2009/0295073 | A1 | 12/2009 | Furusawa | | |
| 2010/0052247 | A1 * | 3/2010 | Kaseda | ..... | 271/226 |

FOREIGN PATENT DOCUMENTS

| | | | |
|---|---|---|---|
| CN | 1151361 | A | 6/1997 |
| GB | 2307468 | A | 5/1997 |
| JP | 5-51136 | * | 3/1993 |
| JP | 5-201555 | * | 8/1993 |
| JP | 5-278869 | * | 10/1993 |
| JP | H08-244989 | A | 9/1996 |
| JP | 2000-016601 | A | 1/2000 |
| JP | 2003-95446 | * | 4/2003 |
| JP | 2004-196436 | * | 7/2004 |
| JP | 2004-196504 | A | 7/2004 |

(Continued)

OTHER PUBLICATIONS

English translation of "Detailed Description" section of Japanese Publication No. 2007-153458.*
English translation of "Detailed Description" section of Japanese Publication No. 2008-201570.*

(Continued)

*Primary Examiner* — Thomas Morrison
(74) *Attorney, Agent, or Firm* — Buchanan Ingersoll & Rooney PC

(57) ABSTRACT

The rear end face of the first upright portion of a trailing edge regulating member is brought into contact with the inner face of a notched sidewall provided in a rear sidewall, and the second upright portion is located above the notched sidewall.

14 Claims, 7 Drawing Sheets

(56) References Cited

FOREIGN PATENT DOCUMENTS

| | | | |
|---|---|---|---|
| JP | 2005-219889 | A | 8/2005 |
| JP | 2007-015807 | A | 1/2007 |
| JP | 2007-153458 | * | 6/2007 |
| JP | 2008-201570 | * | 9/2008 |
| JP | 2009-286573 | A | 12/2009 |
| JP | 2010-265091 | * | 11/2010 |

OTHER PUBLICATIONS

Chinese First Office Action dated Apr. 25, 2013 issued in the corresponding Chinese Patent Application No. 201110049190.2 and English language translation.

Japanese Notice of Grounds of Rejection dated Sep. 17, 2013 issued in the corresponding Japanese Patent Application No. 2010-042809 and English language translation (5 pages).

* cited by examiner

PAPER FEEDING CASSETTE AND IMAGE FORMING APPARATUS

This application is based on Japanese Patent Application No. 2010-042809 filed with the Japan Patent Office on Feb. 26, 2010, the entire content of which is hereby incorporated by reference.

BACKGROUND OF THE INVENTION

1. Field of the Invention

The present invention relates to a paper feeding cassette and an image forming apparatus.

2. Description of the Related Art

The image forming apparatus such as a copy machine, a printer, a facsimile machine, and a multifunctional complex machine employs an electrophotographic system for a process of forming an image onto a paper medium (a sheet of paper). In the electrophotographic system, a toner image which is a visible image is formed on the photoreceptor serving as a recording medium, and then transferred onto the paper medium such as plain paper. In order to keep the toner image held on this paper medium as a permanent image, for example, the paper medium is passed through a heat fixing apparatus to cause the toner to be fixed thereon. Then, the paper medium is discharged from the image forming apparatus to the outside.

The above-described image forming apparatus has a lower stage provided with a paper feeding cassette for storing paper media. In order to accommodate various sizes of paper media, this paper feeding cassette is provided with a side edge regulating plate for regulating the position of both side edges of the paper media and a trailing edge regulating plate for regulating the position of the trailing edge of the paper media in the direction in which the paper media are fed. Japanese Laid-Open Patent Publication No. 2000-016601 is cited as a prior art document disclosing that a paper feeding cassette is provided with a trailing edge regulating plate.

It is effective to provide a trailing edge regulating plate in the paper feeding cassette so as to accommodate various sizes of paper media. However, the paper feeding cassette is required to have a space for providing a trailing edge regulating plate. This may cause an increase in the size of the paper feeding cassette, which also leads to an increase in the area of the floor of the image forming apparatus.

In addition, the trailing edge regulating plate is required to reliably regulate the position of not only a sheet of paper but also stacked sheets of paper.

Accordingly, in order to sufficiently ensure the space for providing a trailing edge regulating plate without changing the area size of the floor of the image forming apparatus, it is necessary to reduce the capacity and decrease the maximum size of the paper media that can be stored in the paper feeding cassette.

SUMMARY OF THE INVENTION

The present invention aims to provide a paper feeding cassette having a structure capable of storing paper media of a relatively large size without increasing the area of the floor of an image forming apparatus, and the image forming apparatus.

A paper feeding cassette according to the present invention loadable into and unloadable from an image forming apparatus body includes a tray housing stacked paper media and having a bottom of an approximately rectangular shape and a sidewall provided to surround the bottom; and a trailing edge regulating member slidably disposed in a guide region placed in the bottom so as to extend along a paper feeding direction in which the paper media are fed and regulating a position of a trailing edge of the paper media in the paper feeding direction.

The trailing edge regulating member includes a base portion and an upright wall provided in the base portion on a rear side in the paper feeding direction. The sidewall includes a rear sidewall provided on a trailing edge side of the paper media in the paper feeding direction. The upright wall includes a first upright portion extending upright from the base portion and a second upright portion provided above the first upright portion and having a rear end face located rearwardly of a rear end face of the first upright portion. When the trailing edge regulating member is located on a rearmost side in the guide region, the rear end face of the first upright portion is brought into contact with an inner face of the rear sidewall and the second upright portion is located above the rear sidewall.

Preferably, the rear sidewall has a notched sidewall which is lower in height from the bottom than the rear sidewall. When the trailing edge regulating member is located on the rearmost side in the guide region, the rear end face of the first upright portion is brought into contact with an inner face of the notched sidewall and the second upright portion is located above the notched sidewall, and a height of the trailing edge regulating member from the bottom is equal to or lower than a height of the rear sidewall from the bottom.

Preferably, a thickness of the second upright portion in the paper feeding direction is greater than a thickness of the first upright portion.

Preferably, the second upright portion includes at least a part of a first elastic portion for regulating movement of the trailing edge regulating member in the paper feeding direction by applying elastic force in a direction orthogonal to the paper feeding direction.

Preferably, the trailing edge regulating member has a second elastic portion brought into contact with the trailing edge of the paper media to bias, in the paper feeding direction, the trailing edge of the paper media in proximity to the bottom. The second elastic portion having an inverted U-shaped portion has one end located on the rear side in the paper feeding direction and the other end located on a forward side in the paper feeding direction. The one end is connected to the second upright portion and the other end is in a non-connected state and brought into contact with the trailing edge of the paper media.

Preferably, the trailing edge regulating member is made of a resin molded product.

Preferably, the paper feeding cassette includes a raising portion raising, from the bottom, a portion of the paper media in proximity to a leading edge of the paper media in the paper feeding direction.

Preferably, the image forming apparatus body includes a pull-out side support frame supporting loading and unloading of the paper feeding cassette and guiding an upper face of the rear sidewall. A notch width of the notched sidewall is less than a width of the pull-out side support frame.

The image forming apparatus according to the present invention has one of the above-described loadable and unloadable paper feeding cassettes.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
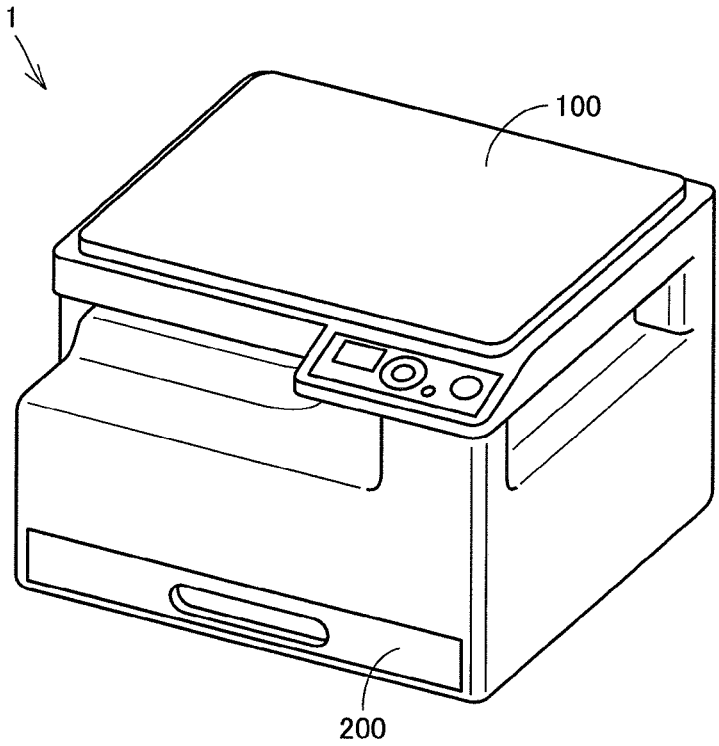
FIG. 1 is a perspective view showing the entire configuration of an image forming apparatus according to the embodiment.

The paper feeding cassette and the image forming apparatus in the embodiment according to the present invention will be hereinafter described with reference to the drawings. In the embodiments described below, when the number, the quantity and the like are mentioned, the scope of the present invention is not necessarily limited thereto unless otherwise specified. Furthermore, the same or corresponding components are designated by the same reference characters, and description thereof may not be repeated.

(Image Forming Apparatus 1)

Figure 2:
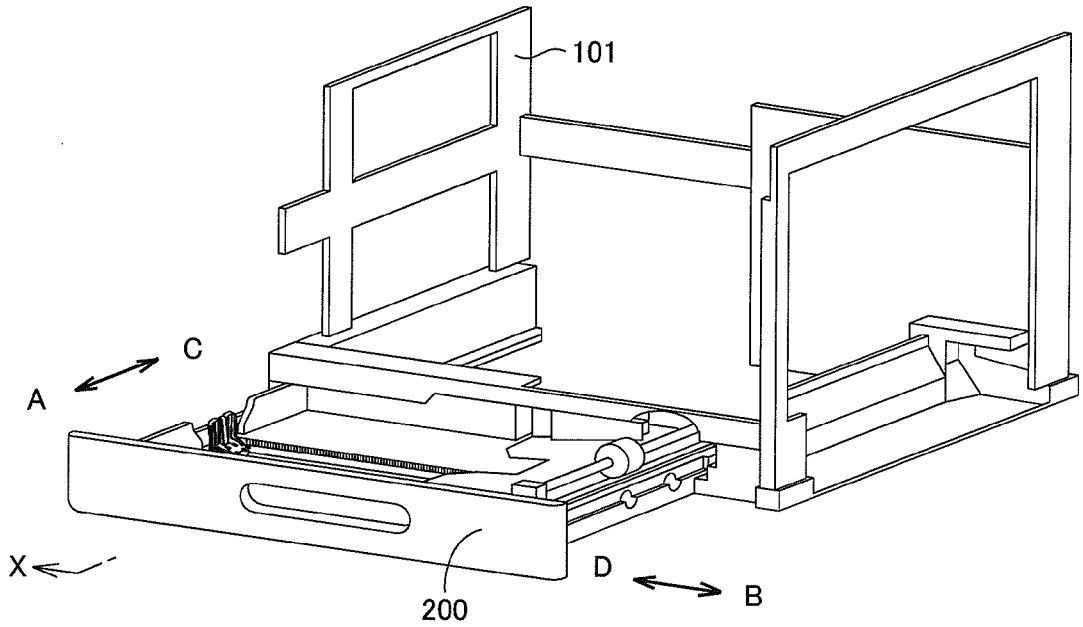
FIG. 2 is a perspective view of a body frame and a paper feeding cassette of the image forming apparatus according to the embodiment.

Referring to FIGS. 1 and 2, the schematic configuration of an image forming apparatus 1 according to the embodiment will then be described. FIG. 1 is a perspective view of the entire configuration of image forming apparatus 1. FIG. 2 is a perspective view of a body frame and a paper feeding cassette of image forming apparatus 1.

Referring to FIG. 1, this image forming apparatus 1 includes an image forming apparatus body 100 and a paper feeding cassette 200 for storing paper media such as plain paper in the lower stage of image forming apparatus body 100.

Image forming apparatus 1 such as a copy machine, a printer, a facsimile machine, and a multifunctional complex machine employs an electrophotographic system for a process of forming an image onto a paper medium. In the electrophotographic system, a toner image which is a visible image is formed on the photoreceptor serving as a recording medium, and then transferred onto the paper medium such as plain paper. In order to keep the toner image held on this paper medium as a permanent image, for example, the paper medium is passed through a heat fixing apparatus to cause the toner to be fixed thereon. Then, the paper medium is discharged from the image forming apparatus to the outside.

Referring to FIG. 2, image forming apparatus body 100 has a body frame 101, and paper feeding cassette 200 is provided such that it can be pulled out with respect to body frame 101 (the direction indicated by an arrow A in FIG. 2). In addition, in the following description, the direction indicated by arrow A shows the direction in which paper feeding cassette 200 is pulled out (pulling-out direction or pull-out side). The direction indicated by an arrow B shows the direction in which the paper media are fed from paper feeding cassette 200 to image forming apparatus body 100 (the paper feeding direction or the forward side). The direction indicated by an arrow C shows the direction in which paper feeding cassette 200 is retracted (the back side direction or the back side). The direction indicated by an arrow D shows the direction opposite to the paper feeding direction (the rearward direction or the rear side).

(Paper Feeding Cassette 200)

Figure 3:
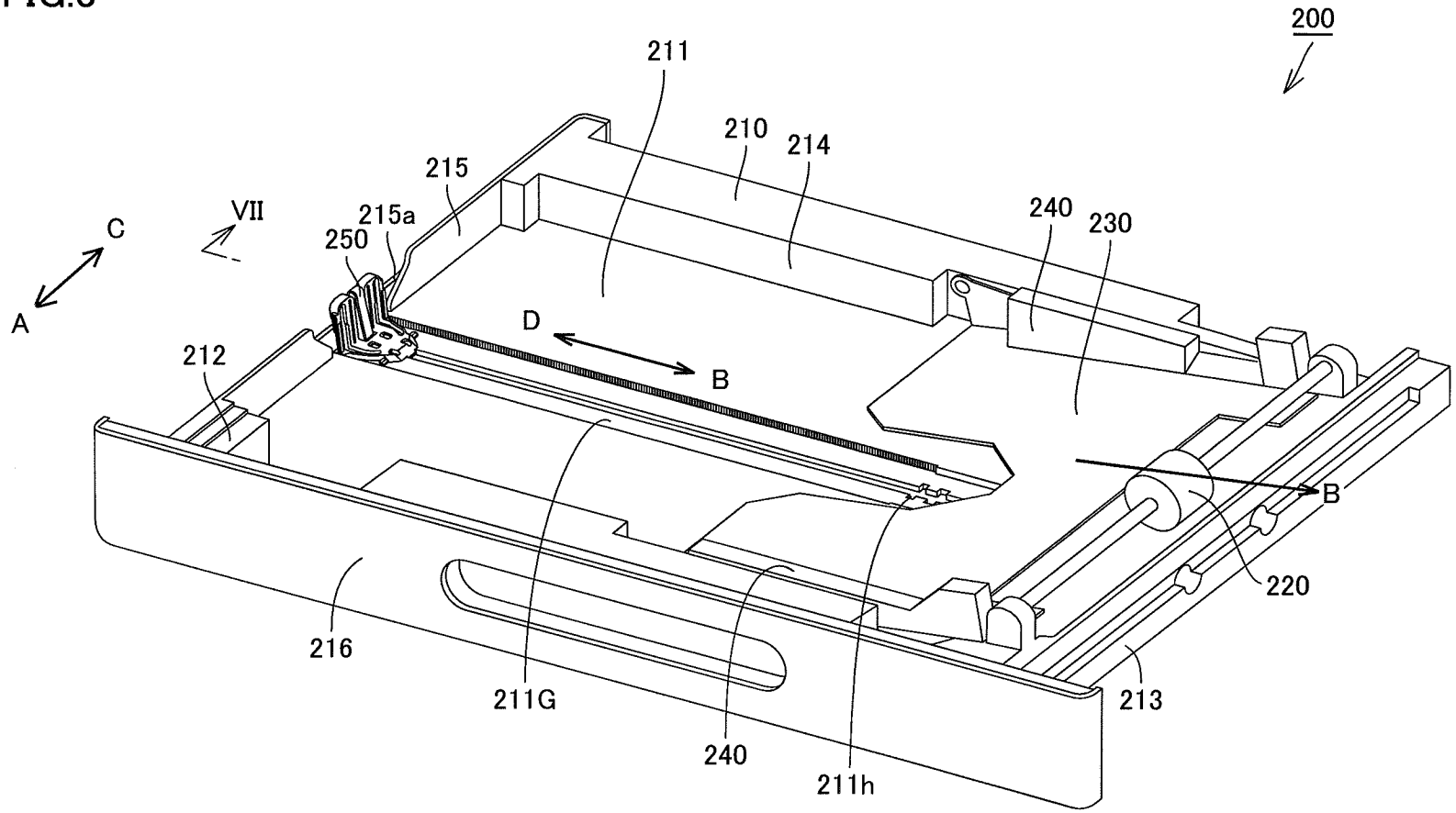
FIG. 3 is a perspective view of the structure of the paper feeding cassette according to the embodiment.

Referring to FIG. 3, the structure of paper feeding cassette 200 will then be described. FIG. 3 is a perspective view of the structure of paper feeding cassette 200. This paper feeding cassette 200 includes a tray 210 housing stacked paper media and having a bottom 211 of an approximately rectangular shape and a sidewall provided so as to surround this bottom 211.

The sidewall includes a pull-out side sidewall 212 located on the pull-out side, a forward sidewall 213 located on the forward side in the paper feeding direction, a back sidewall 214 located on the back side, and a rear sidewall 215 located on the rear side in the paper feeding direction. In addition, pull-out side sidewall 212 is equipped with a pull-out panel 216.

A guide region 211G is provided in bottom 211 so as to extend along the paper feeding direction of the paper media (direction B), and a trailing edge regulating member 250 is slidably disposed along this guide region 211G. This trailing edge regulating member 250 allows regulation of the position of the trailing edge of the paper media on the rear side in the paper feeding direction in accordance with the size of the stacked paper media housed in tray 210.

Bottom 211 is provided on its forward side in the paper feeding direction with a raising plate 230 for raising, from the bottom, a portion of the paper media in proximity to its leading edge in the paper feeding direction (direction B). Raising plate 230 has a leading edge in the paper feeding direction provided with a paper feeding roller 220. In accordance with the remaining number (weight) of the stacked paper media housed in tray 210, the paper medium located at the top is pushed toward paper feeding roller 220 by the elastic member (not shown) provided in raising plate 230.

Each of pull-out side sidewall 212 and back sidewall 214 is provided inside with a side regulating member 240. This side regulating member allows regulation of the position of the side edge corresponding to the side of the stacked paper media in accordance with the size of the stacked paper media housed in tray 210.

(Guide Region 211G)

Figure 4:
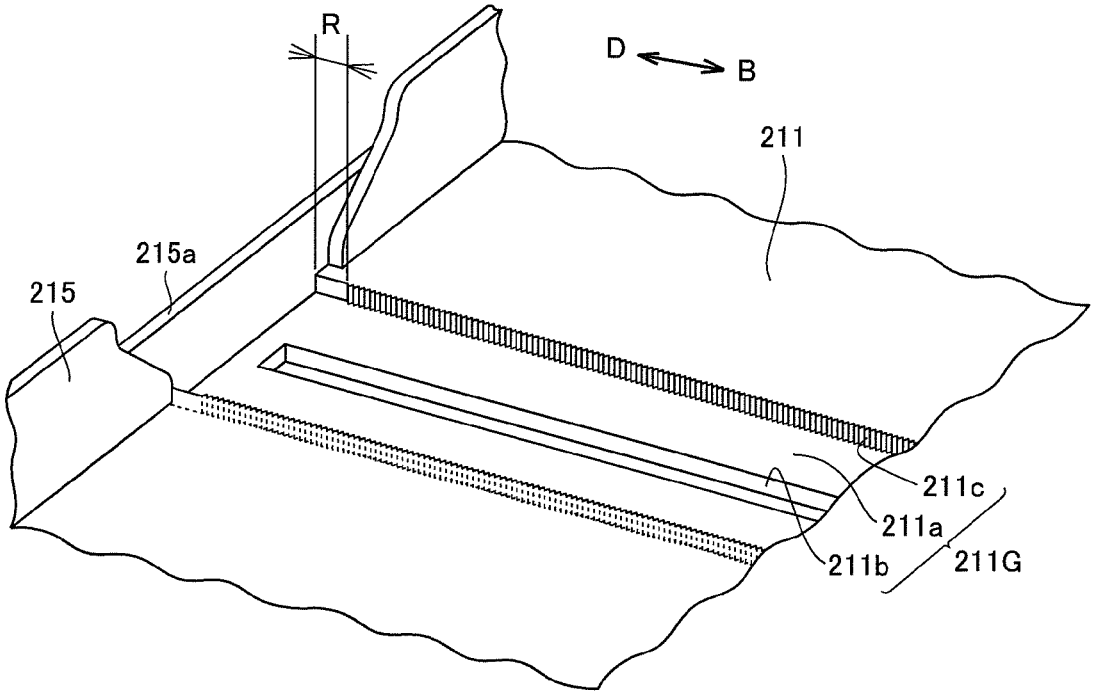
FIG. 4 is a partially enlarged perspective view of a guide region provided in the paper feeding cassette according to the embodiment.

Referring to FIG. 4, the structure of guide region 211G will then be described. FIG. 4 is a partially enlarged perspective view of guide region 211G provided in paper feeding cassette 200. This guide region 211G includes a lower floor portion 211*a* located lower than bottom 211 of tray 210, a groove portion 211*b* provided in the center section of this lower floor portion 211*a*, and a floor side rack 211*c* provided on the side face of the stepped portion between bottom 211 and lower floor portion 211*a*. Lower floor portion 211*a*, groove portion 211*b* and floor side rack 211*c* are disposed so as to extend in paper feeding direction B.

Groove portion 211*b* is provided on its forward side in the paper feeding direction with an opening 211*h* (see FIG. 3) for inserting a guide member 258 and a bottom side engagement member 259 (see FIG. 6) which are provided in trailing edge regulating member 250. Furthermore, for the reasons described below, a region R having no floor side rack 211*c* is provided on the rear side at the side face of the stepped portion between bottom 211 and lower floor portion 211*a*.

(Notched Sidewall 215*a*)

Figure 8:
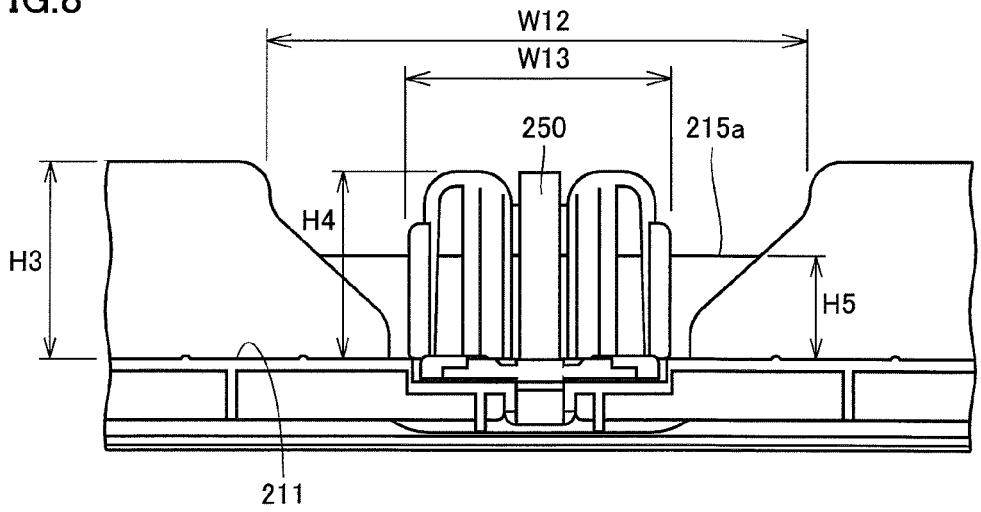
FIG. 8 is a diagram showing the relationship between the trailing edge regulating member and the rear sidewall according to the embodiment.

Rear sidewall 215 has a notched sidewall 215*a* located along the extension line on the rear side of guide region 211G and having an upper end lower than that of rear sidewall 215 (a height H5; see FIG. 8). The details of this notched sidewall 215*a* will be described later together with trailing edge regulating member 250.

(Trailing Edge Regulating Member 250)

Figure 5:
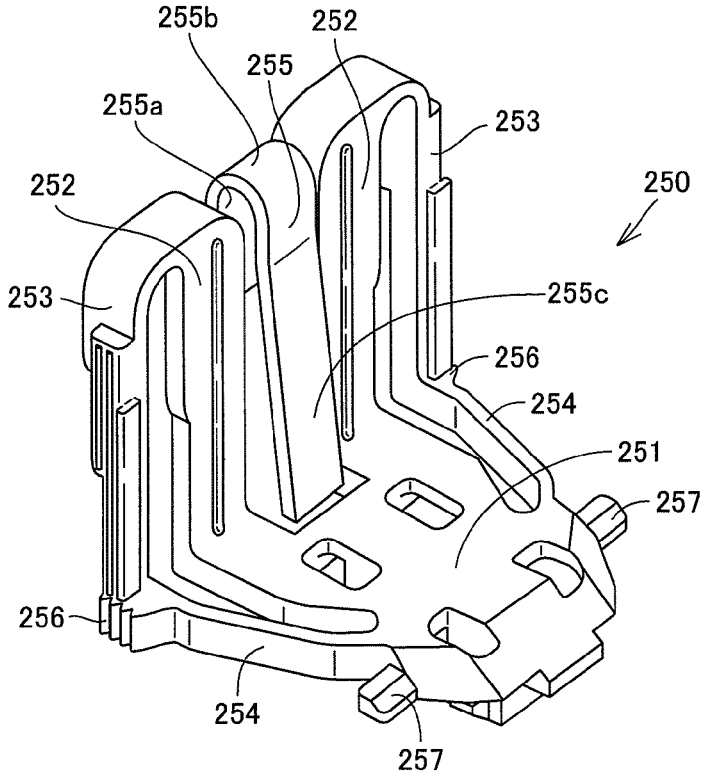
FIG. 5 is a perspective view of a trailing edge regulating member according to the embodiment.
Figure 6:
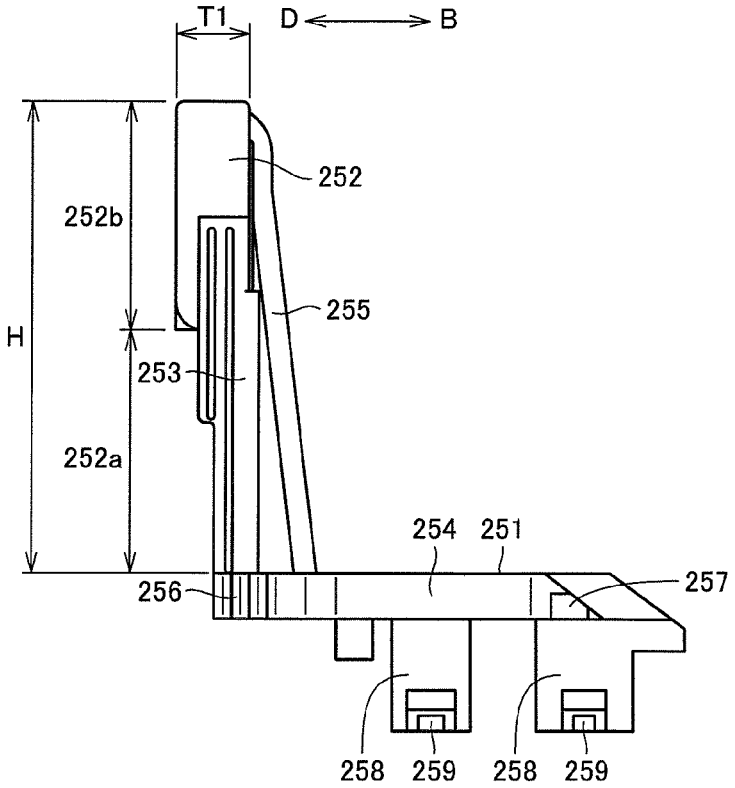
FIG. 6 is a longitudinal cross-sectional view of the trailing edge regulating member according to the embodiment.

Then, referring to FIGS. 5 and 6, the detailed structure of trailing edge regulating member 250 will be hereinafter described. FIG. 5 is a perspective view of trailing edge regulating member 250, and FIG. 6 is a longitudinal cross-sectional view taken along the center section of trailing edge regulating member 250. This trailing edge regulating member 250 includes a base portion 251 having an approximately trapezoidal shape and an upright wall 252 provided on the rear side of base portion 251. Upright wall 252 is provided on either side of base portion 251 spaced across the center section.

Upright wall 252 has a first upright portion 252*a* having a thickness W2 and extending upright from the rear end of base portion 251; and a second upright portion 252*b* having a thickness T1 and having a rear end face located rearwardly of the rear end face of first upright portion 252*a*. In the present embodiment, the front end faces of first upright portion 252*a* and second upright portion 252*b* are flush with each other.

Each upright wall 252 is provided on its outside with a longitudinal elastic piece 253 extending downwardly from the upper end of upright wall 252. Furthermore, base portion 251 is also provided on its outside with a lateral elastic piece 254 which extends from the forward side to the rear side on base portion 251. Longitudinal elastic piece 253 and lateral elastic piece 254 are connected to each other in the region on the rear end side of base portion 251. In this connection region, a regulating member side rack 256 engaged with floor side rack 211*c* is provided. Longitudinal elastic piece 253 and lateral elastic piece 254 constitute the first elastic portion.

Floor side rack 211*c* and regulating member side rack 256 are engaged with each other to form a ratchet mechanism. Specifically, while movement of trailing edge regulating member 250 in the paper feeding direction (direction B) is not regulated, movement of trailing edge regulating member 250 in the rearward direction (direction D) is regulated. In order to move trailing edge regulating member 250 in the rearward direction (direction D), fingers are used to hold longitudinal elastic piece 253 from both sides to push longitudinal elastic piece 253 to be slightly shifted inward, which causes disengagement of regulating member side rack 256 from floor side rack 211*c* for movement of trailing edge regulating member 250.

Thickness T1 of second upright portion 252*b* including longitudinal elastic piece 253 is greater than thickness W2 of first upright portion 252*a*. This allows longitudinal elastic piece 253 to have sufficient elastic force in the direction orthogonal to the paper feeding direction (B), thereby ensuring the engagement between regulating member side rack 256 of trailing edge regulating member 250 and floor side rack 211*c*.

Base portion 251 has a back side provided with two guide members 258 located along the sliding direction and protruding downwardly. Each guide member 258 has bottom side engagement member 259 which protrudes in the outward direction. Furthermore, base portion 251 is also provided at its side face on the front side with a front side engagement member 257 protruding in the outward direction.

Guide member 258 and bottom side engagement member 259 are inserted through opening 211*h* provided in the above-described groove portion 211*b* in guide region 211G on the forward side in the paper feeding direction. Trailing edge regulating member 250 is moved along groove portion 211*b* in this state, which causes lower floor portion 211*a* to be held between bottom side engagement member 259 and base portion 251 together with front side engagement member 257 in another region of groove portion 211*b*. Consequently, trailing edge regulating member 250 can be prevented from being disengaged from groove portion 211*b*.

Furthermore, upright wall 252 has a space along its center section in which an elastic member 255 is provided that is brought into contact with the trailing edge of the paper media to bias the paper media in the forward direction in the paper feeding direction. This elastic member 255 has an inverted U-shape in which the end of one leg 255*a* located on the rear side is connected to a second upright portion 252*b* and the end of the other leg 255*c* located on the forward side is in the non-connected state. This elastic member 255 forms the second elastic portion.

Furthermore, the other leg 255*c* located on the forward side is configured in such a manner that the portion closer to the lower end is more inclined in the forward direction. This configuration is provided because, when the quantity of the stacked paper media is decreased, the forward side of the paper media in the paper feeding direction is greatly lifted by raising plate 230, which requires alignment of the position of the leading edge of the paper media on the forward side in the paper feeding direction.

Furthermore, second upright portion 252*b* has thickness T1 greater than thickness W2 of first upright portion 252*a*. This allows the rigidity of trailing edge regulating member 250 to be ensured. In addition, an inverted U-shaped region 255*b* of elastic member 255 can also be formed to have a thickness T2 greater than thickness W2 of first upright portion 252*a*. This causes elastic member 255 to develop sufficient elastic force (F) in the paper feeding direction. Consequently, the leading edge of the last sheet of the paper media can also be pushed to be located in the paper feeding position with reliability even in the state where the trailing edge of the paper media, particularly of the lower paper media, is inclined by raising plate 230.

Although the description has been made with regard to the case where an integrally molded product made of resin material is employed for trailing edge regulating member 250 in the present embodiment, the assembly formed of metal and the like can also be employed as long as it has the same function.

(Relationship Between Trailing Edge Regulating Member 250 and Notched Sidewall 215*a*)

Figure 7:
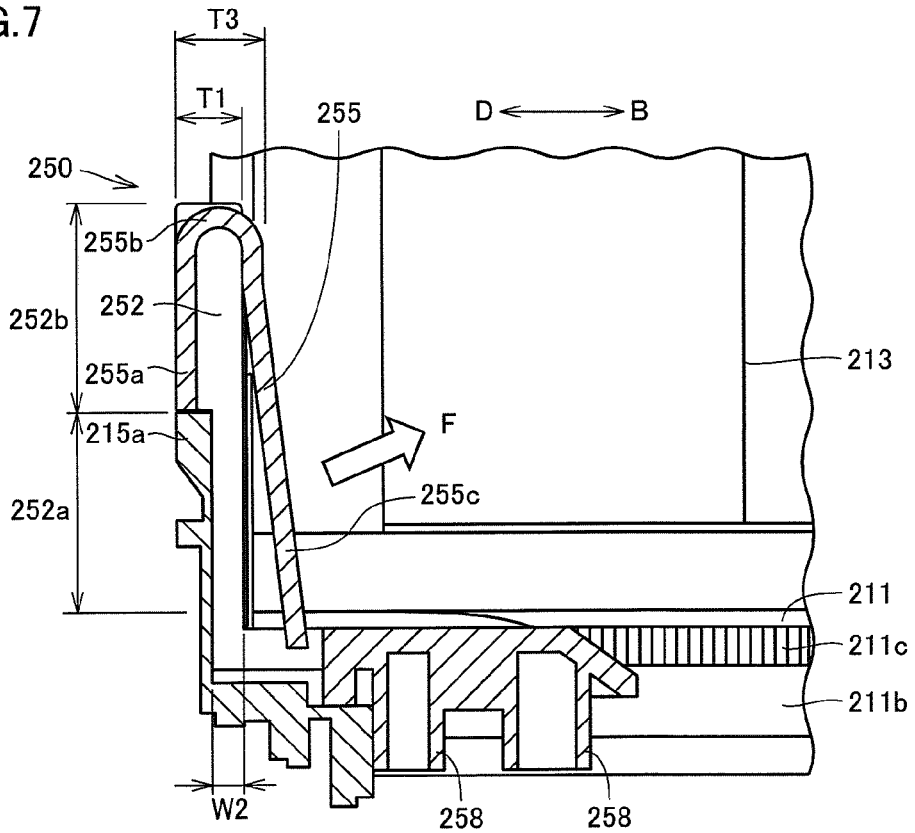
FIG. 7 is a longitudinal cross-sectional view showing the relationship between the trailing edge regulating member and a rear sidewall according to the embodiment.

Then, referring to FIGS. 7 to 9, the relationship between trailing edge regulating member 250 and notched sidewall 215*a* will be hereinafter described. FIG. 7 is a longitudinal cross-sectional view showing the relationship between the trailing edge regulating member and the rear sidewall, which is equivalent to the cross section taken along a line VII in FIG.

3. FIG. 8 is a diagram showing the relationship between the trailing edge regulating member and the rear sidewall. FIG. 9 is a partially enlarged perspective view showing the relationship between the trailing edge regulating member and the guide region.

First, referring to FIG. 7, the figure shows the state where trailing edge regulating member 250 is located on the rearmost side in guide region 211G. In this state, the rear end face of first upright portion 252*a* of trailing edge regulating member 250 is brought into contact with the inner face of notched sidewall 215*a* provided at rear sidewall 215, and second upright portion 252*b* is located above notched sidewall 215*a*.

Thus, second upright portion 252*b* is located above notched sidewall 215*a*, which prevents an increase in the size of the region of paper feeding cassette 200 on the rear side in the paper feeding direction. Therefore, it becomes possible to store the paper media of a larger size without increasing the area of paper feeding cassette 200. For example, in addition to the paper of A3 size, the sheets of paper of 17 inches can be stacked and stored without increasing the area of paper feeding cassette 200.

In the present embodiment, in order to position the inner face of upright wall 252 of trailing edge regulating member 250 closer to the rear side, notched sidewall 215*a* is provided behind rear sidewall 215, to thereby cause the inner face of notched sidewall 215*a* to be located rearwardly, by a thickness (t) of rear sidewall 215, of the inner face of rear sidewall 215. Also, the position of the inner face of rear sidewall 215 may be flush with the position of the inner face of notched sidewall 215*a*.

The description has been made with regard to the case where rear sidewall 215 having notched sidewall 215*a* is employed. However, in the configuration in which the interference with a pull-out side support frame 110 provided in body frame 101 which will be described later is not problematic, rear sidewall 215 having no notched sidewall 215*a* can also be provided with a structure in which the rear end face of first upright portion 252*a* is brought into contact with the inner face of rear sidewall 215 and second upright portion 252*b* is located above rear sidewall 215.

Then, referring to FIG. 8, the height (H4) of trailing edge regulating member 250 from bottom 211 according to the present embodiment is lower than the height (H3) of rear sidewall 215 from bottom 211. This is for the purpose of reliably avoiding the interference with pull-out side support frame 110 provided in body frame 101 described later when paper feeding cassette 200 is pulled out from image forming apparatus body 100. In the present embodiment, the height (H4) of trailing edge regulating member 250 from bottom 211 is set to be lower by about 1.5 mm to 2.5 mm than the height (H3) of rear sidewall 215 from bottom 211.

When there is no problem even if the upper end of trailing edge regulating member 250 is in contact with pull-out side support frame 110, the height (H4) of trailing edge regulating member 250 from bottom 211 can be equal to the height (H3) of rear sidewall 215 from bottom 211.

Furthermore, in the configuration in which the interference between pull-out side support frame 110 and trailing edge regulating member 250 is not problematic, the height (H3) of rear sidewall 215 from bottom 211 is not particularly limited.

Figure 9:
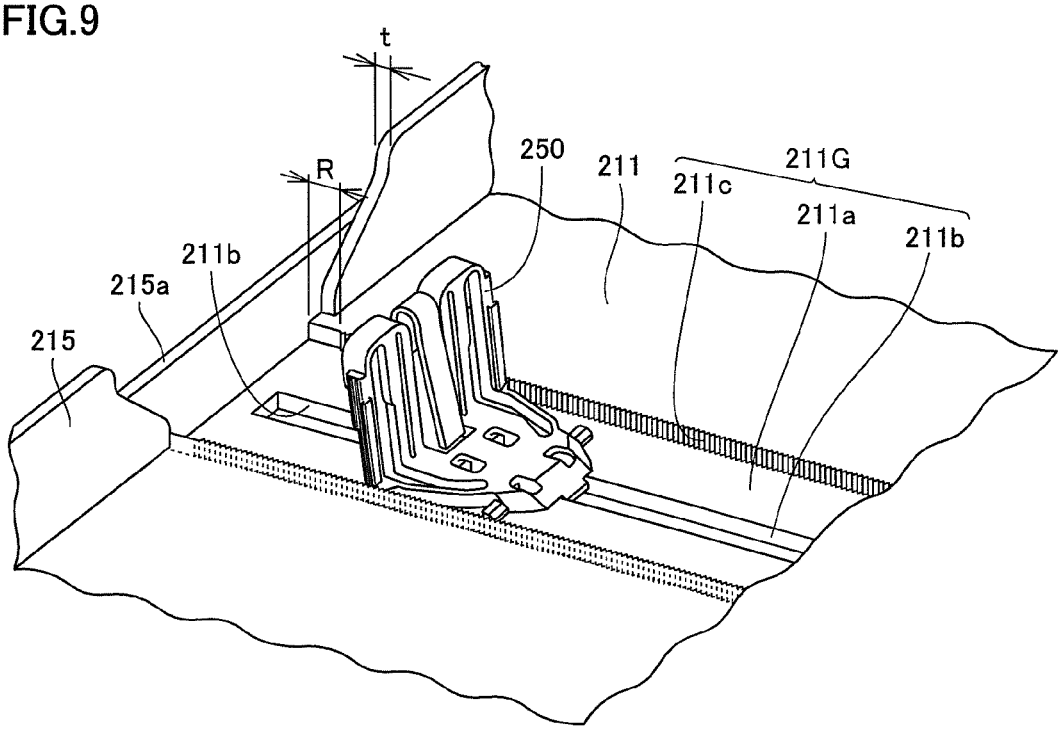
FIG. 9 is a partially enlarged perspective view showing the relationship between the trailing edge regulating member and the guide region according to the embodiment.

Referring to FIG. 9, as described above, region R having no floor side rack 211*c* is provided on the rear side in the paper feeding direction where the side face of the stepped portion between bottom 211 and lower floor portion 211*a* is adjacent to notched sidewall 215*a*. This is because when trailing edge regulating member 250 is located on the rearmost side of guide region 211G, trailing edge regulating member 250 is brought into contact with notched sidewall 215*a*, which leads to restriction of movement of trailing edge regulating member 250 in the rearward direction, thereby eliminating the need to provide a ratchet mechanism.

Furthermore, movement of trailing edge regulating member 250 in the rearward direction requires the operation in which fingers are used to hold longitudinal elastic piece 253 from both sides to be pushed and shifted in the inward direction. When trailing edge regulating member 250 approaches notched sidewall 215*a*, the fingers are brought into contact with rear sidewall 215. Accordingly, it is conceivable that it becomes difficult to perform the operation for holding longitudinal elastic piece 253 from both sides with the fingers. Thus, floor side rack 211*c* is not provided in the region on the rear side adjacent to notched sidewall 215*a*, to thereby facilitate the operation for bringing trailing edge regulating member 250 into contact with notched sidewall 215*a*.

In the present embodiment, the width of notched sidewall 215*a* only needs to be equal to the width that allows second upright portion 252*b* of trailing edge regulating member 250 to be located above notched sidewall 215*a*. However, in order to prevent the fingers from being brought into contact with rear sidewall 215 during the operation of trailing edge regulating member 250, notched sidewall 215*a* is configured to have a notch width (W12) greater than the width (W13) of trailing edge regulating member 250 (see FIG. 8).

(Relationship with Pull-Out Side Support Frame 110 of Body Frame 101)

Figure 10:
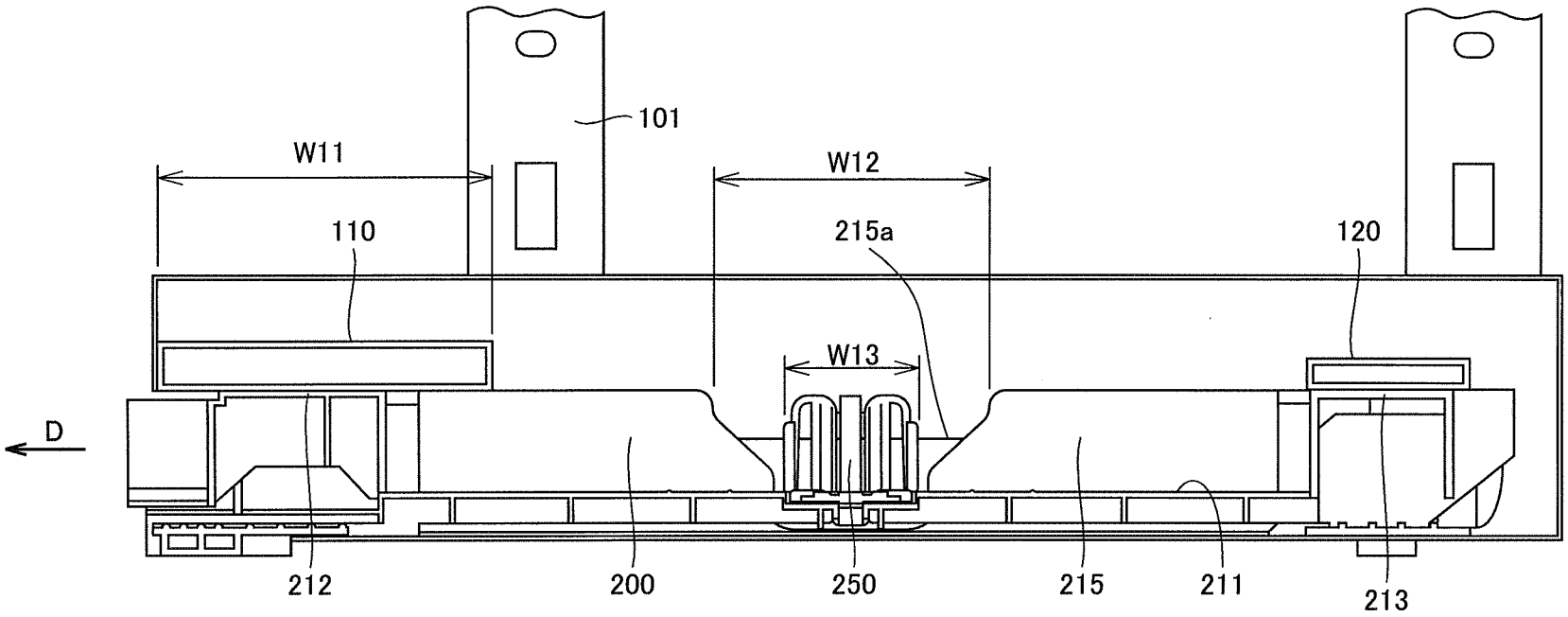
FIG. 10 is a diagram showing the relationship of the trailing edge regulating member and the notched sidewall with a pull-out side support frame provided in the body frame of the image forming apparatus according to the embodiment.
Figure 11:
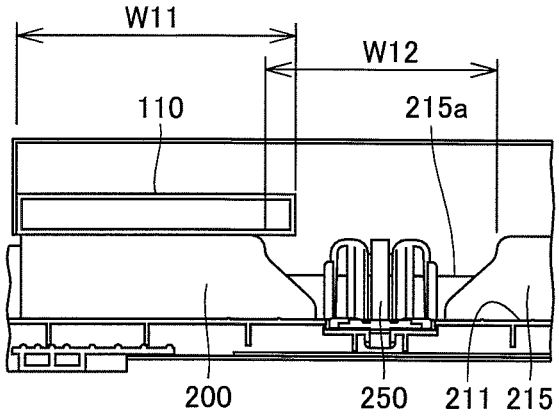
FIGS. 11 to 13 are the first to third diagrams, respectively, showing the state where the paper feeding cassette is pulled out according to the embodiment.
Figure 12:
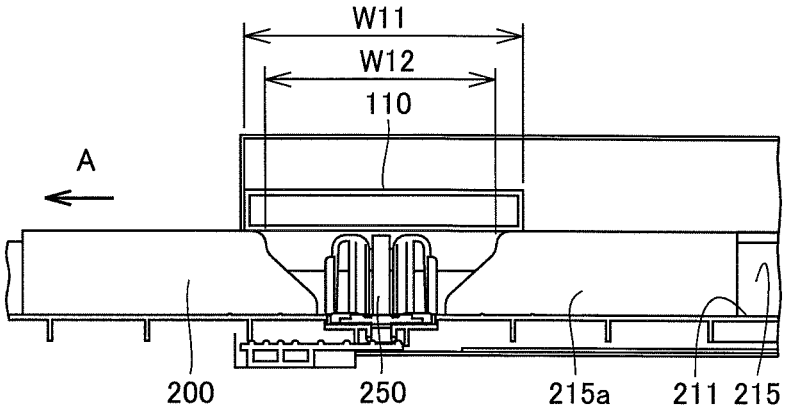
Figure 13:
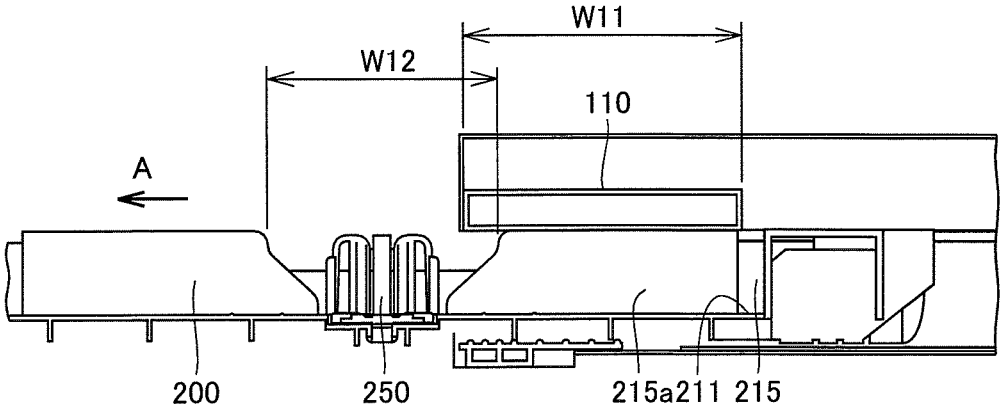

Referring to FIGS. 10 to 13, the description will be made with regard to the relationship between the width of pull-out side support frame 110 provided in frame 101 and the notch width of notched sidewall 215*a*. It is to be noted that FIG. 10 is a diagram showing the relationship of trailing edge regulating member 250 and notched sidewall 215*a* with pull-out side support frame 110 provided in body frame 101 of image forming apparatus 1, which corresponds to the cross section taken along a line X in FIG. 2. Furthermore, FIGS. 11 to 13 are the first to third diagrams, respectively, showing the state where paper feeding cassette 200 is pulled out.

First, referring to FIG. 10, body frame 101 includes pull-out side support frame 110 and a back side support frame 120 for supporting the upper face of rear sidewall 215 of paper feeding cassette 200 when paper feeding cassette 200 is pulled out in the pulling-out direction A. Furthermore, in the present embodiment, notched sidewall 215*a* is configured to have a notch width (W12) smaller than the width (W11) of pull-out side support frame 110. It is to be noted that the support frame is provided on both of the pull-out side and the back side in order to achieve cost reduction and space saving.

Then, referring to FIGS. 11 to 13, the figures show the state where paper feeding cassette 200 is pulled out. FIG. 11 shows the state where paper feeding cassette 200 is completely housed in body frame 101. FIG. 12 shows the state where paper feeding cassette 200 is pulled out to the intermediate position. If the notch width (W12) of notched sidewall 215*a* is greater than the width (W11) of pull-out side support frame 110, pull-out side support frame 110 may fall into the notched region of notched sidewall 215*a* when pull-out side support frame 110 is located above notched sidewall 215*a*. This may cause "jolts" while paper feeding cassette 200 is being pulled out.

Thus, in the present embodiment, notched sidewall 215*a* is configured to have a notch width (W12) smaller than the width (W11) of pull-out side support frame 110, to thereby prevent pull-out side support frame 110 from falling into the notched region of notched sidewall 215*a*, with the result that paper feeding cassette 200 can be smoothly pulled out (see FIG. 13).

Thus, in paper feeding cassette 200 according to the present embodiment and image forming apparatus 1 provided with this paper feeding cassette 200, as described with reference to FIG. 7, the rear end face of first upright portion 252*a* of trailing edge regulating member 250 is brought into contact with the inner face of notched sidewall 215*a* provided at rear sidewall 215, and second upright portion 252*b* is located above notched sidewall 215*a*.

Accordingly, paper feeding cassette 200 does not need to be increased in size on the rear side in the paper feeding direction, which allows the paper media of a larger size to be stored without increasing the area of paper feeding cassette 200. For example, in addition to the sheet of paper of A3 size, the sheet of paper of 17 inches can be stacked and stored without increasing the area of paper feeding cassette 200.

Consequently, it becomes possible to provide a paper feeding cassette having a structure that allows the paper media of a larger size to be stored without increasing the floor area of an image forming apparatus 1 and the image forming apparatus.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A paper feeding cassette loadable into and unloadable from an image forming apparatus body, said paper feeding cassette comprising:

a tray housing stacked paper media and having a bottom of an approximately rectangular shape and a sidewall provided to surround the bottom; and a trailing edge regulating member slidably disposed in a guide region placed in said bottom so as to extend along a paper feeding direction in which said paper media are fed and regulating a position of a trailing edge of said paper media in said paper feeding direction, said trailing edge regulating member including a base portion and an upright wall provided in said base portion on a rear side in said paper feeding direction, said sidewall including a rear sidewall provided on a trailing edge side of said paper media in said paper feeding direction, said upright wall including a first upright portion fixedly attached to said base portion and extending upright from said base portion, and a second upright portion provided directly above said first upright portion and having a rear end face located rearwardly of a rear end face of said first upright portion, and wherein said second upright portion includes a first elastic portion for that regulates movement of said trailing edge regulating member in said paper feeding direction by applying elastic force in a direction orthogonal to said paper feeding direction, and when said trailing edge regulating member is located on a rearmost side in said guide region, the rear end face of said first upright portion is brought into contact with an inner face of said rear sidewall and a least a part of the first elastic portion is located directly above said rear sidewall, and a thickness, in the paper feeding direction, of the second upright portion is thicker than the thickness of the first upright portion, and the thickness, in the paper feeding direction, of the first elastic portion of the second upright portion is substantially the same as the thickness of the second upright portion.

2. The paper feeding cassette according to claim 1, wherein said rear sidewall has a notched sidewall which is lower in height from said bottom than said rear sidewall, when said trailing edge regulating member is located on the rearmost side in said guide region, the rear end face of said first upright portion is brought into contact with an inner face of said notched sidewall and said second upright portion is located above said notched sidewall, and a height of said trailing edge regulating member from said bottom is equal to or lower than a height of said rear sidewall from said bottom.

3. The paper feeding cassette according to claim 1, wherein said trailing edge regulating member has a second elastic portion brought into contact with the trailing edge of said paper media to bias, in said paper feeding direction, said trailing edge of said paper media in proximity to said bottom, said second elastic portion having an inverted U-shaped portion has one end located on the rear side in said paper feeding direction and an other end located on a forward side in said paper feeding direction, said one end is connected to said second upright portion, and said other end is in a non-connected state and brought into contact with the trailing edge of said paper media.

4. The paper feeding cassette according to claim 1, wherein said trailing edge regulating member is made of a resin molded product.

5. The paper feeding cassette according to claim 1, further comprising a raising portion raising, from said bottom, a portion of said paper media in proximity to a leading edge of said paper media in said paper feeding direction.

6. The paper feeding cassette according to claim 2, wherein said image forming apparatus body includes a pull-out side support frame supporting loading and unloading of said paper feeding cassette and guiding an upper face of said rear sidewall, and a notch width of said notched sidewall is less than a width of said pull-out side support frame.

7. The paper feeding cassette according to claim 1, wherein the second upright portion above the first upright portion extends vertically more than the second upright portion extends horizontally.

8. The paper feeding cassette according to claim 1, wherein the second upright portion is located directly over the rear sidewall when the trailing edge regulating member is located on a rearmost side in the guide region.

9. The paper feeding cassette according to claim 1, wherein a thickness, in the paper feeding direction, of an uppermost surface of the first elastic portion is substantially the same as a thickness of the second upright portion.

10. The paper feeding cassette according to claim 1, wherein the first upright portion and the second upright portion are formed uniformly including the first elastic portion.

11. The paper feeding cassette according to claim 10, wherein the first upright portion has a second elastic portion extending in a vertical direction and the first elastic portion and the second elastic portion is connected and apply elastic force in the direction orthogonal to said paper feeding direction.

12. The paper feeding cassette according to claim 11, wherein said trailing edge regulating member is made of a resin molded product.

13. An image forming apparatus having a loadable and unloadable paper feeding cassette, said paper feeding cassette comprising:

a tray housing stacked paper media and having a bottom of an approximately rectangular shape and a sidewall provided to surround the bottom; and a trailing edge regulating member slidably disposed in a guide region placed in said bottom so as to extend along a paper feeding direction in which said paper media are fed and regulating a position of a trailing edge of said paper media in said paper feeding direction, said trailing edge regulating member including a base portion and an upright wall provided in said base portion on a rear side in said paper feeding direction, said sidewall including a rear sidewall provided on a trailing edge side of said paper media in said paper feeding direction, said upright wall including a first upright portion fixedly attached to said base portion and extending upright from said base portion, and a second upright portion provided directly above said first upright portion and having a rear end face located rearwardly of a rear end face of said first upright portion, and wherein said second upright portion includes a first elastic portion far that regulates movement of said trailing edge regulating member in said paper feeding direction by applying elastic force in a direction orthogonal to said paper feeding direction, and when said trailing edge regulating member is located on a rearmost side in said guide region, the rear end face of said first upright portion is brought into contact with an inner face of said rear sidewall and a least a part of the first elastic portion is located directly above said rear sidewall, and a thickness, in the paper feeding direction, of the second upright portion is thicker than the thickness of the first upright portion, and the thickness, in the paper feeding direction, of the first elastic portion of the second upright portion is substantially the same as the thickness of the second upright portion.

14. The image forming apparatus according to claim 13, wherein a thickness, in the paper feeding direction, of an uppermost surface of the first elastic portion is substantially the same as a thickness of the second upright portion.

* * * * *